US008573746B2

(12) United States Patent
Miyata

(10) Patent No.: US 8,573,746 B2
(45) Date of Patent: Nov. 5, 2013

(54) LIQUID EJECTION HEAD WIRING MEMBER AND LIQUID EJECTION HEAD

(75) Inventor: Yoshinao Miyata, Matsukawa-mura (JP)

(73) Assignee: Seiko Epson Corporation, Tokyo (JP)

( * ) Notice: Subject to any disclaimer, the term of this patent is extended or adjusted under 35 U.S.C. 154(b) by 336 days.

(21) Appl. No.: 13/025,553

(22) Filed: Feb. 11, 2011

(65) Prior Publication Data

US 2011/0205270 A1 Aug. 25, 2011

(30) Foreign Application Priority Data

Feb. 19, 2010 (JP) ..... 2010-034388

(51) Int. Cl.
*B41J 2/14* (2006.01)
*B41J 2/05* (2006.01)

(52) U.S. Cl.
USPC ..... 347/50; 347/58

(58) Field of Classification Search
CPC . B41J 2/14233; B41J 2/04541; B41J 2/04543
USPC ..... 347/9–11, 54, 57–59, 68, 50
See application file for complete search history.

(56) References Cited

U.S. PATENT DOCUMENTS

| | | | | |
|---|---|---|---|---|
| 7,479,729 | B2 * | 1/2009 | Sugahara et al. | 310/365 |
| 7,866,800 | B2 * | 1/2011 | Kubo et al. | 347/68 |
| 2009/0096842 | A1 | 4/2009 | Kubo et al. | |
| 2009/0113686 | A1 | 5/2009 | Sugahara et al. | |

FOREIGN PATENT DOCUMENTS

| | | |
|---|---|---|
| JP | 2005-254616 | 9/2005 |

* cited by examiner

*Primary Examiner* — An Do
(74) *Attorney, Agent, or Firm* — Workman Nydegger

(57) ABSTRACT

A wiring member for a liquid ejection head enables reducing the size of the liquid ejection head. A flexible printed circuit has on one end a plurality of individual electrode wiring terminals corresponding to individual element electrode terminals of piezoelectric elements; individual electrode wires corresponding to the individual electrode wiring terminals; a common electrode wiring terminal corresponding to a common electrode terminal of the piezoelectric elements; and a common electrode wire corresponding to the common electrode wiring terminal. The individual electrode wiring terminals, common electrode wiring terminal, and individual electrode wires are disposed on one side of the flexible printed circuit, and the common electrode wire is disposed on the other side of the flexible printed circuit.

6 Claims, 8 Drawing Sheets

LIQUID EJECTION HEAD WIRING MEMBER AND LIQUID EJECTION HEAD

BACKGROUND

1. Technical Field

The present invention relates to a wiring member used in a liquid ejection head such as an inkjet recording head, and to a liquid ejection head having the same. More particularly, the invention relates to a liquid ejection head wiring member having wiring terminal rows formed by arranging wiring terminals corresponding to the pressure generating elements of a liquid ejection head arrayed in rows, and to a liquid ejection head having the wiring member.

2. Related Art

One type of liquid ejection head that discharges fluid droplets from a nozzle by varying the pressure of the fluid inside a pressure chamber discharges fluid droplets by deforming a piezoelectric element (a type of pressure generating element) connected to a diaphragm. This type of liquid ejection head discharges droplets from the nozzles using the change in pressure produced by applying a drive voltage (drive pulse) to drive the piezoelectric element to change the volume of the pressure chamber, thereby varying the pressure of the fluid stored in the pressure chamber.

The piezoelectric element is electrically connected to a COF (Chip On Film), TCP (Tape Carrier Package) or other type of flexible printed circuit having a semiconductor chip for driving the piezoelectric element, and drive voltage is supplied thereto through the flexible printed circuit. See, for example, JP-A-2005-254616. The piezoelectric element includes a bottom electrode layer, a piezoelectric layer, and a top electrode layer. Generally, one electrode (for example, the bottom electrode layer) is used as a common element electrode connected in common to a plurality of piezoelectric elements, and the other set of electrodes (for example, the top electrode layer) are used as individual element electrodes connected to the individual piezoelectric elements. The piezoelectric layer disposed between the common element electrode and the individual element electrodes is the active piezoelectric portion in which piezoelectric strain is produced by applying a drive voltage to the electrodes.

FIG. 7 schematically describes the layout of the element electrodes of the piezoelectric elements and the element electrode wiring units (lead electrode units) extending from the element electrodes in the actuator unit 69 (refer to FIG. 8) of a recording head according to the related art. Note that the dark hatching in the figure indicates the individual element electrodes and the individual element electrode wiring units electrically connected thereto, and the light hatching indicates the common element electrode and the common element electrode wiring unit electrically connected thereto. Note also that the nozzles (piezoelectric elements) are oriented vertically as seen in the figure. Each pressure chamber and each piezoelectric element are coupled to each of the nozzles, and only two rows of nozzles are shown in the figure.

In the configuration shown in the drawing, common element electrode 70 that is connected in common with the piezoelectric elements is continuously formed in the nozzle row direction on an elastic film (not shown) defining part of each pressure chamber, and a piezoelectric layer (not shown) and an individual element electrode 71 are sequentially laminated thereon in a pattern corresponding to each of the piezoelectric elements. An individual element electrode terminal 72 (a type of individual element electrode wiring unit) electrically connected to an individual element electrode 71 is formed between the adjacent nozzle rows for each of the individual element electrodes 71. The individual element electrode terminals 72*a* corresponding to one nozzle row (the left side in the drawing) and the individual element electrode terminals 72*b* corresponding to the other nozzle row (the right side in the drawing) are arranged in alternating rows in the nozzle row direction. The individual element electrode terminals 72 are the parts that are electrically connected to the individual electrode wiring terminals 77 on one end of a flexible printed circuit 68 (see FIG. 8).

Further, a common element electrode unit 73 (a type of common element electrode wiring unit) is formed surrounding the area where the common element electrode 70, the individual element electrode 71, and the individual element electrode terminal 72 are formed.

The common element electrode unit 73 is a frame including a common vertical electrode unit 73*a* and a common transverse electrode unit 73*b*. The common vertical electrode unit 73*a* extends in the nozzle row direction on the outside of each nozzle row (the opposite side as the side on which the individual element terminals are formed). The common transverse electrode unit 73*b* extends in a direction perpendicular to the nozzle row direction on both ends of the nozzle row direction. The common element electrode unit 73 is electrically connected to the common element electrodes 70 via each branch electrode unit 74.

A common element electrode terminal 75 that is connected to the common electrode wiring terminal 78 of the flexible printed circuit is rendered in portions of the common element electrode unit 73 at positions on opposite sides of the individual element electrode terminals 72 in the nozzle row direction as indicated by the dotted circles in the figure.

As shown in FIG. 8, the flexible printed circuit 68 has a configuration in which a control chip 76 that controls applying the drive voltage to the piezoelectric elements, and a wiring pattern including individual electrode lines and common electrode lines (not shown in the figure), are disposed to the surface of a polyimide or other type of base film, and the control chip 76 and the wiring pattern are then covered by a resist without covering the wiring terminals (individual electrode wiring terminals 77 and common electrode wiring terminals 78).

Further, multiple individual electrode wiring terminals 77 corresponding to the individual element electrode terminals 72 of the actuator unit are formed on one end of the flexible printed circuit. A common electrode wiring terminal 78 corresponding to the common element electrode terminal 75 of the actuator unit is also formed at this end of the FPC 68 at the outside end of the row of individual electrode wiring terminals 77.

Generally, the wiring terminals, the wiring pattern, and the control chip 76 are rendered on only one side of the flexible printed circuit 68. In addition, when wired to the actuator unit 69, this end of the flexible printed circuit is bent between the wiring terminals and the wiring pattern at a substantially right angle to the opposite side as the side on which the wiring pattern is formed. Each of the wiring terminals 77 and 78 is solder plated, and the wiring terminals 77 and 78 are soldered and thereby electrically connected to the corresponding element terminals 71 and 75 of the actuator unit, and the flexible printed circuit 68 is connected to the actuator unit 69.

However, with the recording head according to related art as described above, the common electrode wiring, the individual electrode wiring, the wiring terminals, and the drive control IC are provided on one side of the flexible printed circuit, and the area occupied by the common electrode wiring is significantly smaller than the area occupied by the drive control IC and individual electrode wiring due to installation space limitations. If the wiring space used for the common electrodes, including the common element electrode wiring unit of the actuator unit, is narrow, the resistance of the electrode may cause a voltage drop in the electrode surface, causing the drive voltage applied to the piezoelectric element to fluctuate and the amount or velocity of the ink discharged from the nozzle to vary. The likelihood of this problem occurring increases as the number of simultaneously discharging nozzles increases.

To solve this problem, the recording head according to the related art requires a larger area for the common element electrode wiring unit of the actuator unit, and prevents reducing the size of the recording head accordingly.

SUMMARY

A wiring member for a liquid ejection head according to one aspect of the invention enables reducing the size of the liquid ejection head. Another aspect of the invention is a liquid ejection head having the wiring member.

A first aspect of the invention is a wiring member for a liquid ejection head that supplies a drive voltage to an actuator unit of the liquid ejection head, the liquid ejection head including an actuator unit that has a plurality of pressure generating elements that eject fluid from a nozzle communicating with a pressure chamber by changing the pressure of the fluid inside the pressure chamber by applying a drive voltage between an individual element electrode and a common element electrode. The wiring member includes a plurality of individual electrode wiring terminals corresponding to individual element electrode terminals of the pressure generating elements; individual electrode wires corresponding to the individual electrode wiring terminals; a common electrode wiring terminal corresponding to a common element electrode terminal of the pressure generating elements; and a common electrode wire corresponding to the common electrode wiring terminal. The individual electrode wiring terminals, the common electrode wiring terminal, and the individual electrode wires are formed on one side of the wiring member, and the common electrode wiring is formed on the other side of the wiring member.

In this aspect of the invention the individual electrode wiring terminals, the common electrode wiring terminal, and the individual electrode wires are formed on one side of the wiring member, and the common electrode wires are formed on the other side of the wiring member, and a larger area can therefore be secured for the common electrode wires than is possible with the wiring member according to the related art. A voltage drop in the common electrode can therefore be suppressed when a plurality of nozzles simultaneously discharge ink. The area of the common element electrode unit of the actuator unit can also be suppressed accordingly. The size of the liquid ejection head can therefore be reduced.

Preferably, the wiring member also has a through-hole that connects the common electrode wiring terminal on one side to the common electrode wiring on the other side.

Further preferably, one end of the wiring member is bent so that the individual electrode wiring terminals and the common electrode wiring formed at the one end face element terminals of an actuator unit, and the wiring terminals are respectively connected to the corresponding element terminals.

Another aspect of the invention is liquid ejection head that applies a drive voltage to a pressure generating element via the liquid ejection head wiring member described above, the liquid ejection head including: an actuator unit which includes a plurality of the pressure generating elements that eject a fluid from a nozzle communicating with a pressure chamber by causing a variation in the pressure of the fluid inside the pressure chamber by applying a drive voltage between an individual element electrode and a common element electrode; an individual element electrode connection portion which is electrically connected to the individual element electrode; and a common element electrode connection portion which is electrically connected to the common element electrode. The individual element electrode connection portion is connected to a corresponding individual electrode wiring terminal of the wiring member, and the common element electrode connection portion is connected to a corresponding common electrode wiring terminal of the wiring member.

Because this aspect of the invention can secure a larger pattern formation area for the common electrode wiring of the wiring member than is possible with a wiring member according to the related art, the area of the common element electrode wiring unit on the pressure generating element side can be reduced accordingly, and the size of the liquid ejection head can therefore be reduced.

Another aspect of the invention is a fluid ejection apparatus including the liquid ejection head described above. As a result, the size of the fluid ejection apparatus can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

An exemplary embodiment of the invention is described with reference to the accompanying drawings. Note that while the invention is described below with reference to a specific preferred embodiment including certain limitations, the scope of the invention is not so limited unless specifically stated. In addition, an inkjet recording head ("recording head" below) that is used in an inkjet printer (a type of liquid ejection device according to the invention) is described below as a preferred embodiment of a liquid ejection head according to the invention.

Figure 1:
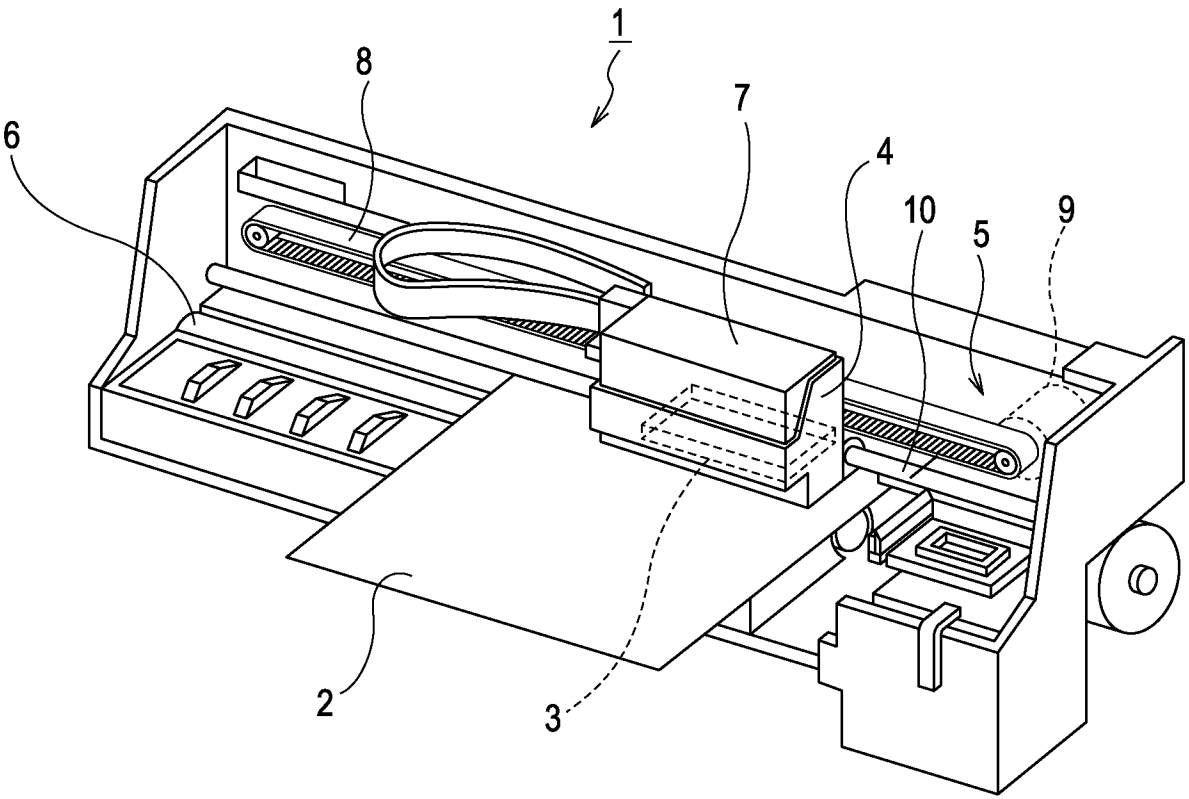
FIG. 1 is an oblique view of a printer according to a preferred embodiment of the invention.

The basic configuration of a printer 1 according to this embodiment of the invention is described first below with reference to FIG. 1.

The printer 1 is deposits fluid ink onto the surface of a paper or other type of recording medium 2 to record images. The printer 1 includes a recording head 3 that ejects (discharges)

the ink, a carriage 4 to which the recording head 3 is attached, a carriage drive mechanism 5 that moves the carriage 4 in the primary scanning direction, and a platen roller 6 that conveys the recording medium 2 in the secondary scanning direction. The ink is a type of fluid as used in the invention, and is stored in an ink cartridge 7. The ink cartridge 7 is removably disposed to the recording head 3. Note also that a configuration in which the ink cartridge 7 is disposed on the frame side of the printer 1, and ink is supplied from the ink cartridge 7 to the recording head 3 via an ink supply tube is also conceivable.

The carriage drive mechanism 5 includes a timing belt 8. The timing belt 8 is driven by a pulse motor 9 such as a DC motor. When the pulse motor 9 operates, the carriage 4 moves reciprocally in the primary scanning direction (widthwise to the recording medium 2) guided by a guide rod 10 disposed to the printer 1.

Figure 2:
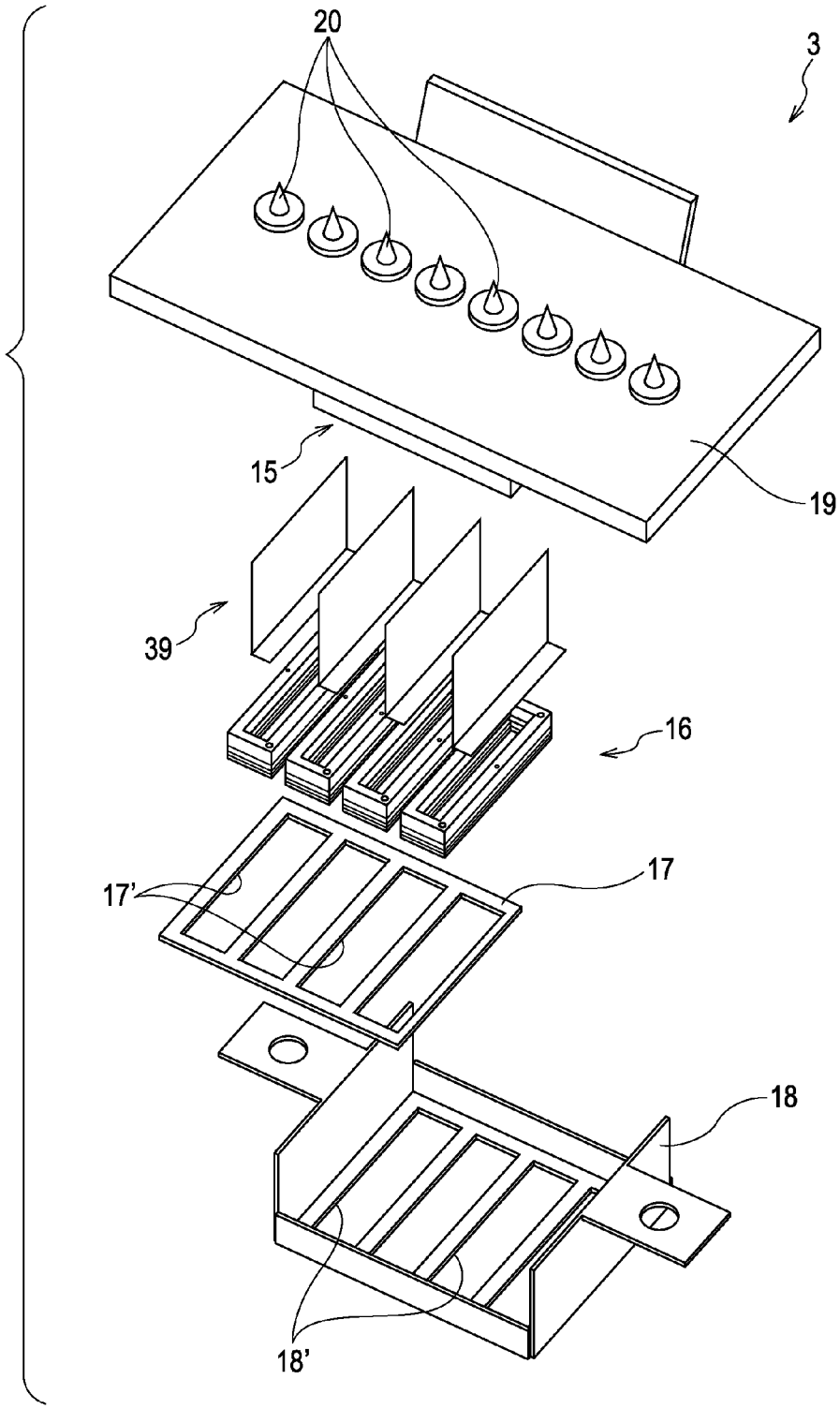
FIG. 2 is an exploded oblique view of the recording head from diagonally above.

FIG. 2 is an exploded oblique view illustrating the configuration of the recording head 3. The recording head 3 of the embodiment includes a case 15, a plurality of head units 16, a unit holding plate 17, and a head cover 18.

The case 15 is a box-shaped member that contains a collection channel (not shown) and the head unit 16, and has a needle holder 19 formed at the top. The needle holder 19 is a flat member used to hold ink needles 20. In this embodiment of the invention eight ink needles 20 corresponding to the colors of ink in the ink cartridge 7 are disposed to the needle holder 19 The ink needles 20 are hollow, and are inserted into the ink cartridge 7 to carry ink stored inside the ink cartridge 7 from a hole (not shown) in the end to the head unit 16 through the collection channel inside the case 15.

The four head units 16 are held by the metal unit holding plate 17, and attached to the bottom of the case 15 by a metal head cover 18. The metal unit holding plate 17 has four openings 17' corresponding to the four head units 16, which are positioned side by side in the primary scanning direction, and the head cover 18 likewise has four openings 18' corresponding to the head units 16.

Figure 3:
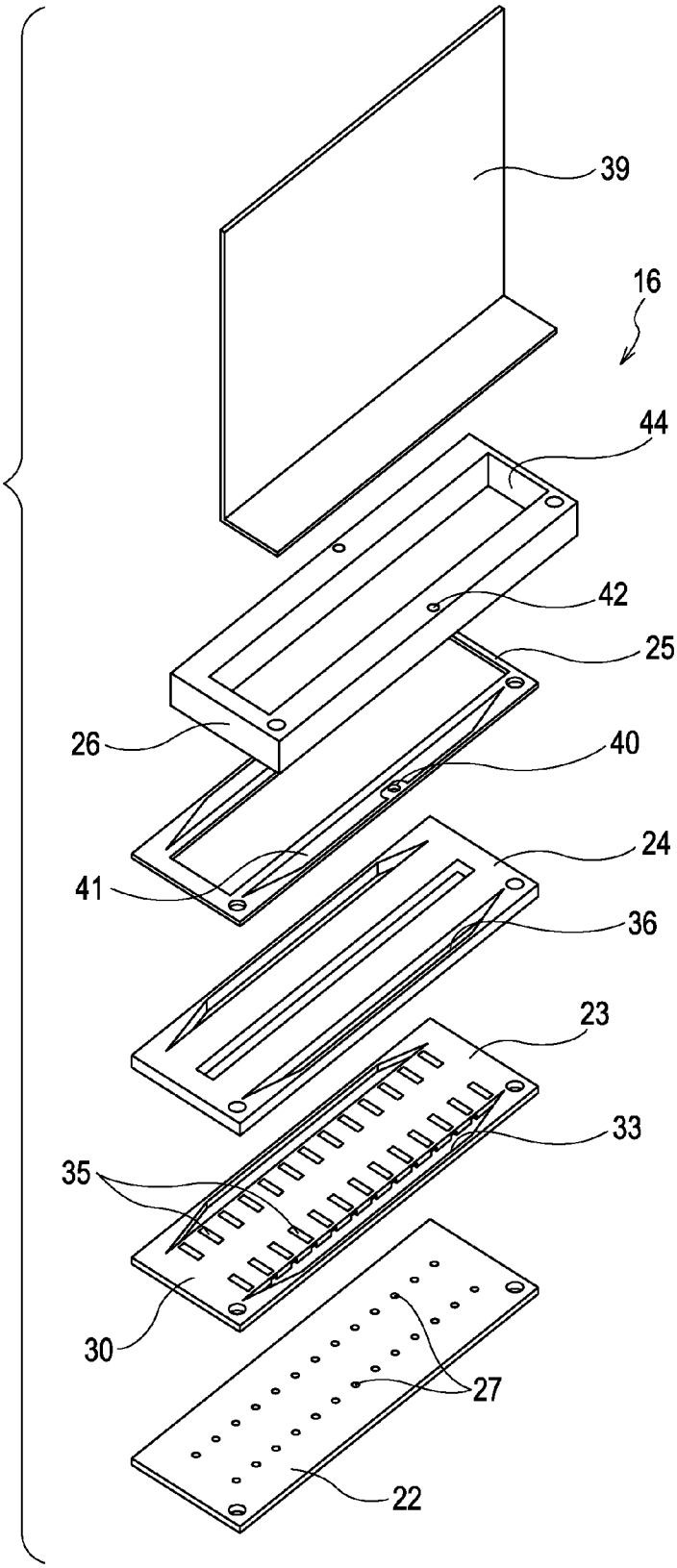
FIG. 3 is an exploded oblique view of the head unit.
Figure 4:
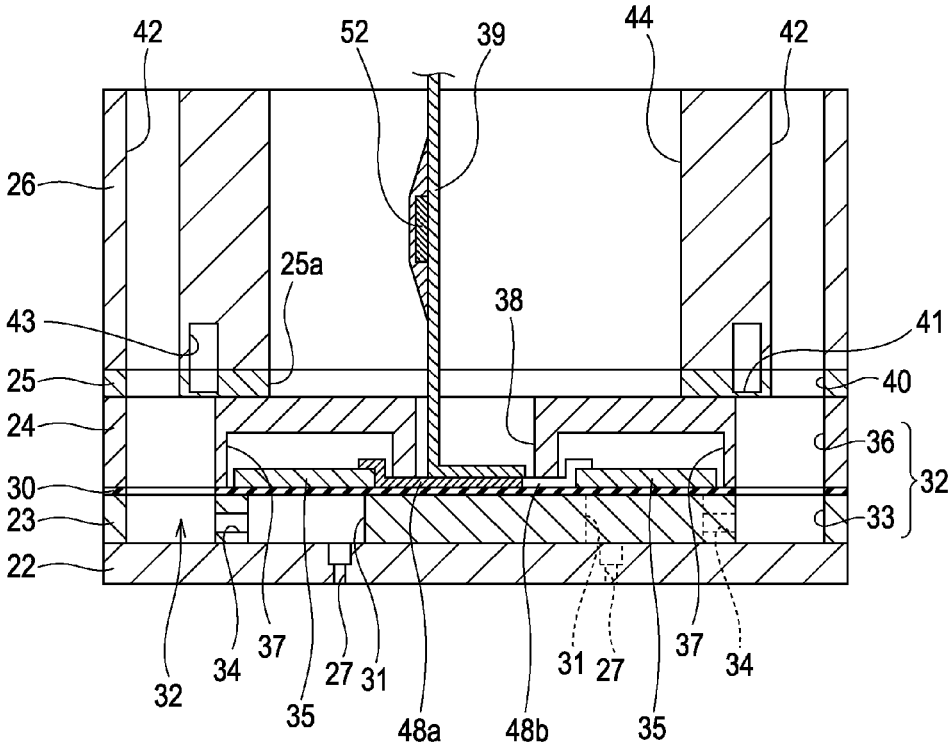
FIG. 4 is a section view of the head unit.

FIG. 3 is an exploded oblique view, and FIG. 4 is a section view of the head unit 16 (a liquid ejection head as more narrowly defined than the recording head 3). Note that for convenience of description the direction in which the various members are stacked together is referred to below as the vertical direction.

The head unit 16 in this embodiment of the invention includes a nozzle plate 22, a channel substrate 23, a common fluid chamber substrate 24, and a compliance substrate 25 that are stacked together and attached to a unit case 26.

The nozzle plate 22 (a type of nozzle formation member) is a plate having a plurality of nozzles 27 formed at a pitch corresponding to the dot density. In this embodiment, the nozzle row (a type of nozzle group) is formed by arranging three hundred nozzles 27 at a 300 dpi pitch. In this embodiment, two nozzle rows are formed on the nozzle plate 22.

An extremely thin elastic film 30 of silicon dioxide is formed on the top surface of the channel substrate 23 (on the side facing the common fluid chamber substrate 24) by thermal oxidation. As shown in FIG. 4, a plurality of pressure chambers 31 that are separated by walls formed by anisotropic etching are formed on the channel substrate 23 corresponding to the nozzles 27. A communication chamber 33 that is part of the common fluid chamber 32, which is a chamber into which ink common to the pressure chambers 31 is introduced, is formed on the outside of the row of pressure chambers 31 in the channel substrate 23. The communication chamber 33 communicates with each of the pressure chambers 31 via an ink supply path 34.

A piezoelectric element 35 (a type of pressure generating element of the invention) is formed on the elastic film 30 on top of the channel substrate 23 for each of the each of the pressure chambers 31. The piezoelectric elements are formed by sequentially laminating a metal bottom electrode layer (a common element electrode 46), a piezoelectric layer (not shown) of lead zirconate titanate (PZT), for example, and a metal top electrode layer (an individual element electrode 47). In this embodiment of the invention, two rows of piezoelectric elements (which is a pressure generating element group of the invention) corresponding to the two nozzle rows are arranged perpendicularly to the nozzle rows with the piezoelectric elements 35 staggered in the nozzle row direction. The piezoelectric elements 35 are a so-called flexible mode piezoelectric element, and are formed covering the upper portion of the pressure chamber 31. Note that a configuration in which the bottom electrode layer is the individual element electrode 47, and the top electrode layer is the common element electrode 46, is also possible.

Electrode wiring units 48 and 49 respectively extend from the element electrodes 47 and 46 of the piezoelectric element 35 to the surface of the elastic film 30, and the portions corresponding to the electrode terminals of the electrode wiring units are electrically connected to the wiring terminals 53 and 57 of a flexible printed circuit 39. The piezoelectric elements 35 are formed so that they deform when a drive voltage is applied between the individual element electrode 47 and the common element electrode 46 via the flexible printed circuit 39. In this embodiment of the invention the elastic film 30, the piezoelectric elements 35 including the electrodes 46 and 47, and the electrode wiring units 48 and 49 electrically connected to the electrodes of the piezoelectric elements 35 render the actuator unit of the invention. In addition, the electrode wiring unit and the flexible printed circuit 39 are further described below.

The common fluid chamber substrate 24 (protection substrate) having a through-hole 36 formed in the thickness direction is disposed on the channel substrate 23 provided with the piezoelectric elements 35. The common fluid chamber substrate 24 is formed by using a single-crystal silicon substrate similarly to the channel substrate 23 or the nozzle plate 22. The through-hole 36 in the common fluid chamber substrate 24 communicates with the communication chamber 33 of the channel substrate 23 and defines a part of the common fluid chamber 32.

A piezoelectric element housing cavity 37 sized so that it does not interfere with driving the corresponding piezoelectric element 35 is formed in the common fluid chamber substrate 24 facing each piezoelectric element 35.

A wiring hole 38 is formed passing through the thickness of the common fluid chamber substrate 24 between the adjacent rows of piezoelectric elements. The individual element electrode terminals 48 and the common element electrode terminals 51 of the piezoelectric elements 35 (FIG. 5) are disposed inside the wiring hole 38 when seen in plan view.

The compliance substrate 25 is disposed on top of the common fluid chamber substrate 24. An ink inlet 40 for supplying ink from the ink needle 20 side to the common fluid chamber 32 is formed passing through the thickness of the compliance substrate 25 in an area opposite the through-hole 36 of the common fluid chamber substrate 24. The areas outside the through-hole 25*a* described below and the ink inlet 40 in the area facing the through-hole 36 of the compliance substrate 25 are extremely thin flexible portions 41 that seal the open tops of the through-holes 36 and define the common fluid chamber 32. This flexible portion 41 functions as a compliance unit that absorbs variation in the pressure of the ink inside the common fluid chamber 32.

A through-hole 25*a* is formed in the center of the compliance substrate 25. The through-hole 25*a* communicates with a cavity 44 in the unit case 26.

An ink supply path 42 and a recess 43 are formed in the unit case 26. The ink supply path 42 communicates with the ink inlet 40 and supplies ink introduced from the ink needle 20 side to the common fluid chamber 32 side. The recess 43 is formed in an area opposite the flexible portion 41 and allows the flexible portion 41 to expand. The cavity 44 is formed passing through the thickness of the center of the unit case 26. One end of the flexible printed circuit 39 is inserted to the cavity 44 and connected to the element electrode terminal of the actuator unit.

The nozzle plate 22, the channel substrate 23, the common fluid chamber substrate 24, the compliance substrate 25, and the unit case 26 are laminated together by heating an adhesive or heat welding film placed between each of the layers.

The recording head 3 including the head unit 16 described above is attached to the carriage 4 so that each nozzle plate 22 faces the platen and the nozzle rows are aligned with the secondary scanning direction. Each head unit 16 receives the ink from the ink cartridge 7 supplied through the ink supply path 42 from the ink inlet 40 to the common fluid chamber 32, and fills the ink channel (a type of fluid channel) from the common fluid chamber 32 to the nozzles 27 with ink. When drive voltage from the flexible printed circuit 39 is then supplied to the piezoelectric element 35, causing the piezoelectric element 35 to bend, the pressure of the ink inside the corresponding pressure chamber 31 changes, and ink is discharged from the nozzle 27 by using this change in the ink pressure.

Figure 5:
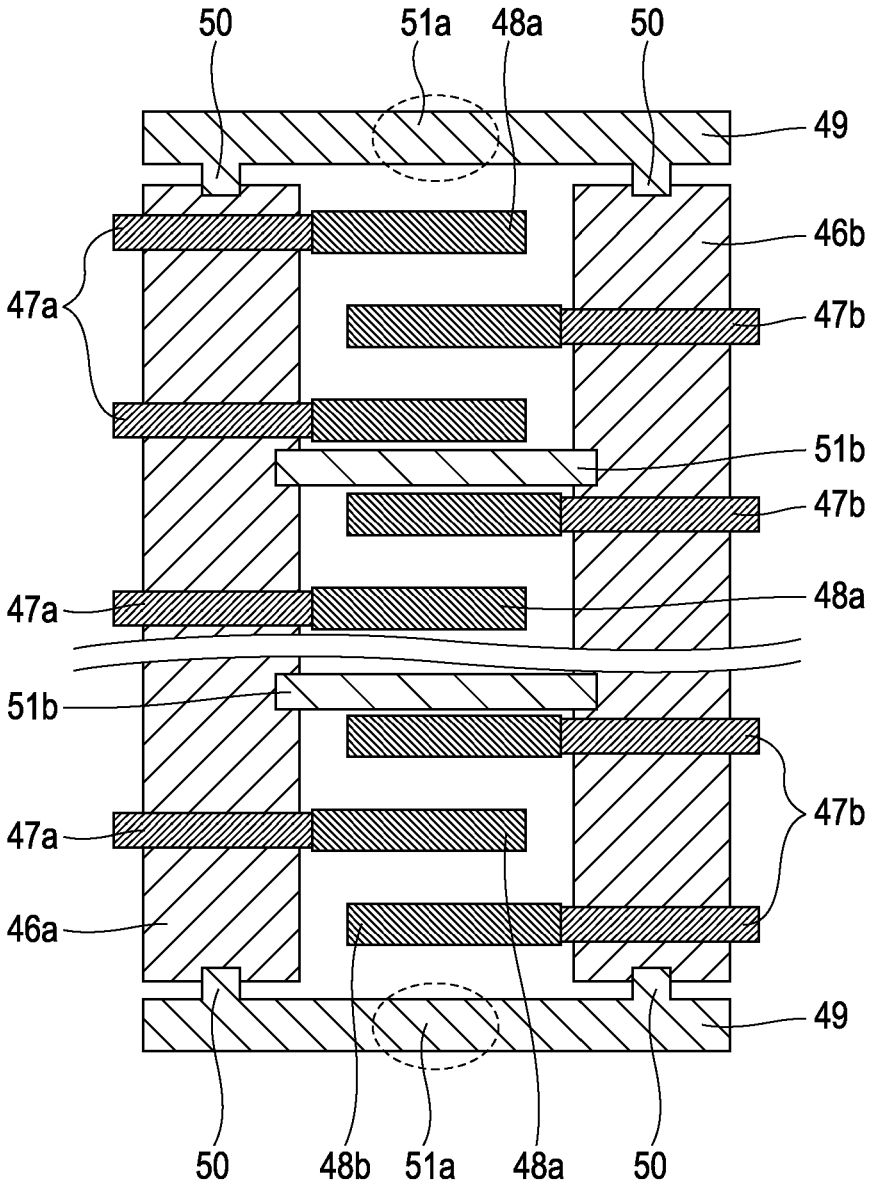
FIG. 5 schematically describes the layout of the element electrode wiring unit and the element electrodes of the piezoelectric device.

FIG. 5 schematically describes the layout of the element electrodes of the piezoelectric element 35 and the element electrode wiring unit extending from the element electrodes. The dark hatching in the figure indicates the individual element electrode 47 and the individual element electrode wiring unit 48 connected thereto, and the light hatching indicates the common element electrode 46 and the common element electrode wiring unit 49 connected thereto. The vertical direction in the figure is the nozzle row direction (the piezoelectric element row direction), and the configuration for two rows of nozzles is shown. In this embodiment of the invention platinum or gold is used for the electrode film.

In this embodiment of the invention, the common element electrodes 46 (46*a* and 46*b*) that are common to the piezoelectric elements 35 are continuously formed as a series of rectangles with the long side aligned with the nozzle row direction on the elastic film 30 defining a part of the pressure chamber 31. A piezoelectric layer (not shown) and the individual element electrodes 47 (47*a* and 47*b*) are sequentially laminated thereon and are patterned for each of the piezoelectric elements 35.

The length of the long side of the individual element electrodes 47 is slightly longer than the width of the short side of the common element electrode 46. The width (length of the short side) of the individual element electrode 47 is substantially equal to the width of the pressure generating element 35.

An individual element electrode terminal 48 (a type of individual element electrode wiring unit) that has a thin rectangular shape when seen in plan view and is connected to an individual element electrode 47 is formed for each of the individual element electrodes 47 between the adjacent nozzle rows. The length of the individual element electrode terminals 48 is set to prevent contact with the neighboring common element electrode 46. Further, the width (the length of the short side) of the individual element electrode terminal 48 is substantially equal to the width of the individual element electrode 47.

The individual element electrode terminals 48*a* corresponding to one nozzle row (the left side in the figure) and the individual element electrode terminals 48*b* corresponding to the other nozzle row (the right side in the figure) are disposed in rows at a constant pitch alternating in the nozzle row direction. The individual element electrode terminals 48 are electrically connected to the individual electrode wiring terminal 53 on one end of the flexible printed circuit 39 (see FIG. 6).

The common element electrode unit 49 (a type of common element electrode wiring unit) is formed on both sides of the nozzle row direction of the common element electrodes 46*a* and 46*b*. The common element electrode unit 49 extends across the common element electrodes 46*a* and 46*b* corresponding to the nozzle rows perpendicularly to the nozzle row direction, and is connected to the common element electrodes 46*a* and 46*b* via a branch electrode unit 50. The parts of the common element electrode unit 49 located at the opposite ends of the individual element electrode terminals 48 in the row direction, that is, the parts indicated by the dotted circles in FIG. 5, are the common element electrode terminals 51*a* that are connected to the common electrode wiring terminal 78 on one end of the flexible printed circuit.

A common element electrode terminal 51*b* that connects the common element electrodes 46*a* and 46*b* to each other is formed between the adjacent common element electrodes 46*a* and 46*b* at a position offset from the individual element electrode terminals 48. When seen in plan view, the common element electrode terminal 51*b* is a narrow rectangular electrode terminal substantially equal in width to the individual element electrode terminals 48, and is disposed between adjacent individual element electrode terminals 48. A common element electrode terminal 51*b* is provided between every several or several ten individual element electrode terminals 48 and not between all of the individual element electrode terminals. A plurality of common element electrode terminals 51*b* are thus formed in a row at positions offset from the individual element electrodes 48 at an interval greater than the gap between the individual element electrodes 48 in the group of individual element electrodes arrayed at a constant interval in the nozzle row direction. The common element electrode terminals 51*b* are electrically connected to the common electrode wiring terminal 57 on one end of the flexible printed circuit 39 (see FIG. 6).

Figure 6A:
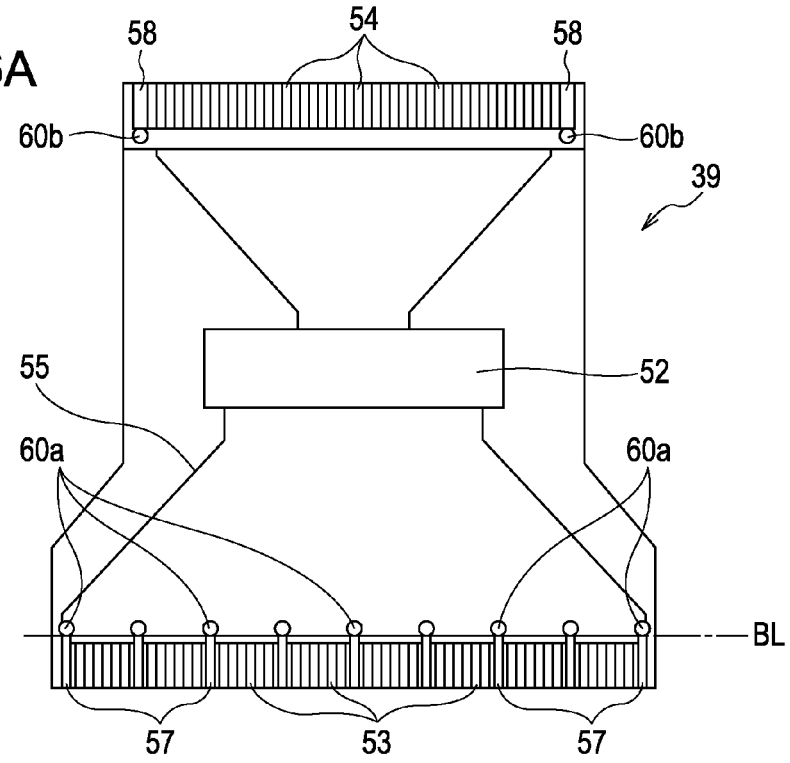
FIGS. 6A and 6B describe the configuration of a flexible printed circuit.
Figure 6B:
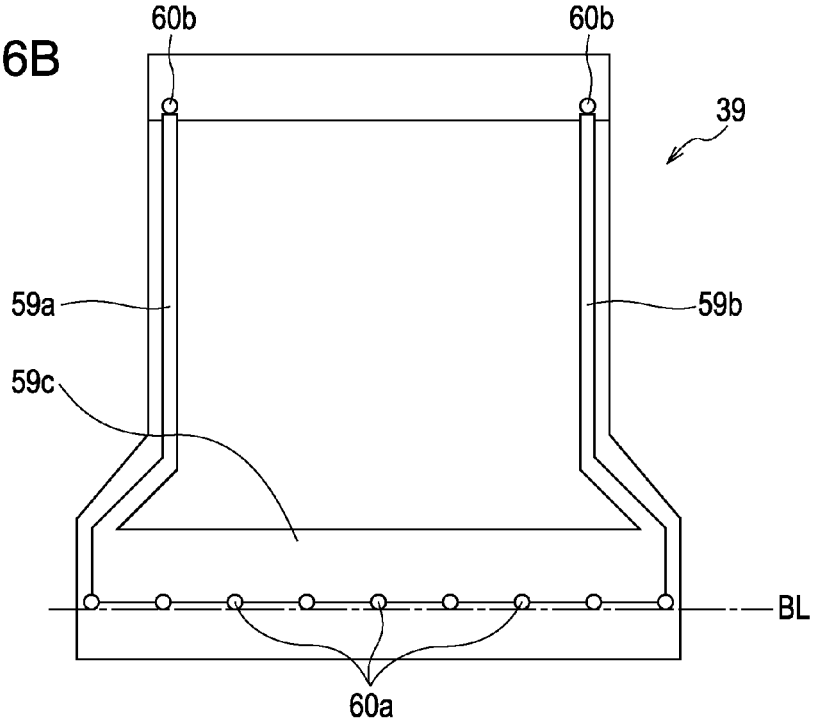

FIGS. 6A and 6B show the configuration of the flexible printed circuit 39 (a type of wiring member according to the invention), where FIG. 6A shows the configuration of the front side of the flexible printed circuit 39, and FIG. 6B shows the configuration of the back side of the flexible printed circuit 39.

The flexible printed circuit 39 has a control chip 52 that controls applying drive voltage to the piezoelectric element 35 mounted on one side (the front) of a rectangular base film such as polyimide together with a pattern of individual electrode wires 55 connected to the control chip 52.

Further, a plurality of individual electrode wiring terminals 53 (a type of individual electrode wiring terminal according to the invention) corresponding to the individual element electrode terminals 48 on the actuator unit side are disposed on one end (the lower end in FIG. 6) on the front of the flexible printed circuit 39. A plurality of common electrode wiring terminals 57 (a type of common electrode wiring terminal according to the invention) corresponding to the common element electrode terminals 51 (51*a* and 51*b*) on the actuator unit side are similarly disposed at positions avoiding the individual element electrodes 48 on the front of the same end of the flexible printed circuit 39.

A through-hole 60*a* is rendered on the other end of each common electrode wiring terminal 57. The through-hole 60*a* is formed to connect the common electrode wiring terminals 57 on the front with the common electrode wires 59 (see FIG. 6B) on the back.

A plurality of individual electrode wiring terminals 54 that connect to the connector of a circuit board (not shown in the figure) that relays signals form the printer are formed in a row on the front of the other end of the flexible printed circuit 39 (the top end in FIG. 6). Common electrode wiring terminals 58 that connect to the connector of the same circuit board are also formed the front of this other end of the flexible printed circuit 39 on the opposite ends of the row of the individual electrode wiring terminal group. Through-holes 60*b* are also disposed to the one end side of the common electrode wiring terminals 58. The other-end-side through-hole 60*b* is formed to connect the common electrode wiring terminals 58 on the front with the common electrode wires 59 on the back.

The common electrode wires 59 are formed on the back side of the flexible printed circuit 39, that is, opposite side as the front described above. The common electrode wires 59 include vertical common electrode wires 59*a* and 59*b*, which are formed on opposite sides of the width of the cable and connect the through-holes 60*a* on the one end with the through-holes 60*b* on the other end of the cable, and a transverse common electrode wire 59*c* that connects the vertical common electrode wires 59*a* and 59*b* to each other. The transverse common electrode wire 59*c* is a wiring unit formed in a band across the ends of the terminals, that is, along the width of the flexible printed circuit 39, and is connected to each through-hole 60*a*.

The common electrode wiring terminals 57 on one end and the common electrode wiring terminals 58 on the other end of the front of the flexible printed circuit 39 are thus connected to each other via the through-holes 60*a* on the one end, the transverse common electrode wire 59*c* [sic, J=59] formed on the back of the flexible printed circuit 39, and the through-holes 60*b* on the other end of the cable. The common electrode wires 59 are not connected to the control chip 52, and are connected to the ground line of the printer 1.

The parts of the flexible printed circuit 39 other than the wiring terminals 53, 54, 57, and 58, that is, the surface of the control chip 52 and the wires 55 and 59, are covered by a resist.

When wiring to the actuator unit, one end of the flexible printed circuit 39 is bent at substantially a right angle to the back side at a virtual line BL between the wiring terminal formation area and the wiring pattern formation area (refer to FIGS. 3 and 4). When thus bent the portions where the wiring terminals 53 and 57 are formed are opposite the element electrode terminals 48 and 51 of the actuator unit when attached to the actuator unit. The wiring terminals 53 and 57 are previously solder plated. The wiring terminals 58 and 59 are then soldered and electrically connected to the corresponding element electrode terminals 48 and 51 of the actuator unit, thereby connecting the flexible printed circuit 39 to the actuator unit.

More specifically, the individual electrode wiring terminals 53 on one end of the flexible printed circuit 39 are connected to the corresponding individual element electrode terminals 48 of the actuator unit, and the common electrode wiring terminals 57 of the flexible printed circuit 39 are respectively connected to the corresponding common element electrode terminals 51*a* and 51*b* of the actuator unit. The wiring terminals 54 and 58 are also soldered and electrically connected to the corresponding connectors of the foregoing circuit board.

The individual electrode wiring terminals 53 and 54, the individual electrode wires 55, the common electrode wiring terminals 57 and 58, and the control chip 52 are thus disposed on side (the front) of the flexible printed circuit 39, and the common electrode wires 59 are disposed on the other side (the back). As a result, a larger area can therefore be secured for the common electrode wires 59 on the flexible printed circuit 39 than is possible with a wiring member according to the related art. More particularly, the wiring of the flexible printed circuit 39 can be made of copper, for example, and rendered thicker than the electrodes and wiring film on the actuator unit side, and a voltage drop in the common electrode can be suppressed when simultaneously discharging ink from plural nozzles 27.

Figure 7:
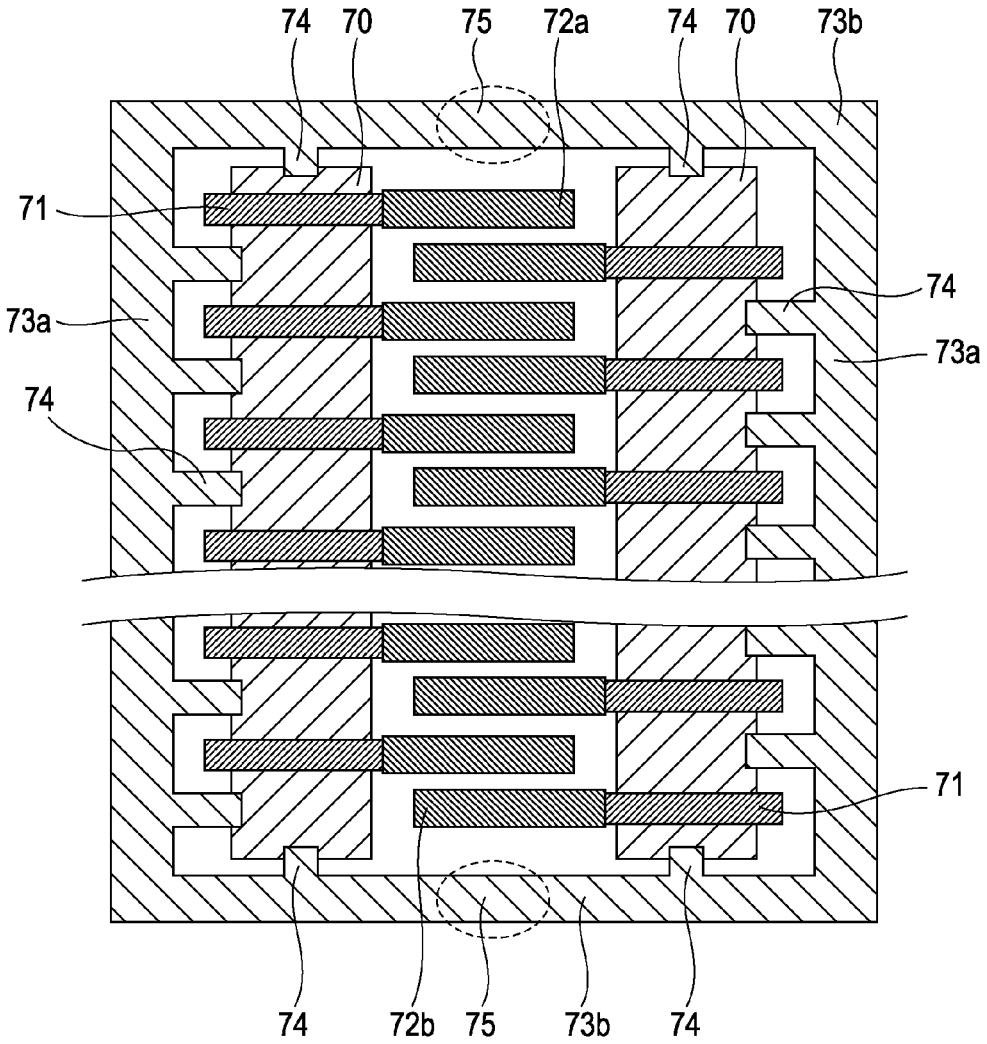
FIG. 7 schematically describes the layout of an element electrode wiring unit and the element electrodes of a piezoelectric device in a recording head according to the related art.
Figure 8:
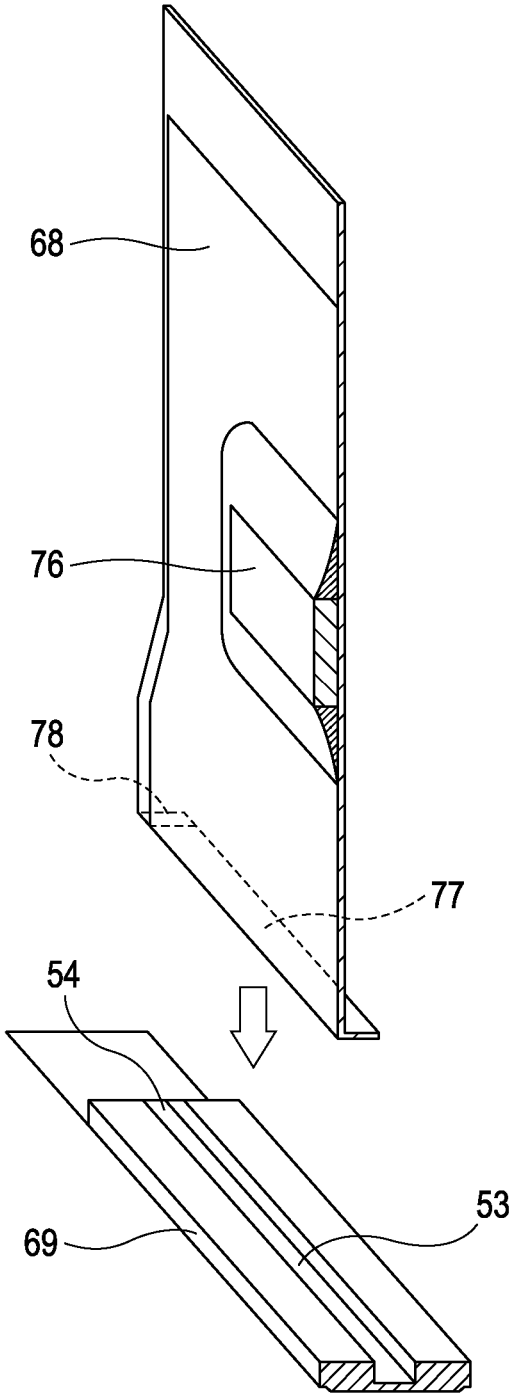
FIG. 8 is a oblique view describing the configuration of an actuator unit and flexible printed cable according to the related art.

The area of the common element electrode unit of the actuator unit can also be reduced accordingly. More specifically, for example, the common vertical electrode units (reference numeral 73*a* in FIG. 7) that extend in the nozzle row direction and are required to prevent a voltage drop in the recording head according to the related art are not necessary with the recording head 3 according to the invention, or the width at least may be narrower than in the recording head according to the related art. The size of the recording head 3 can therefore be reduced.

An inkjet recording head 3 (head unit 16) is described above as an example of a liquid ejection head according to the invention, but the invention is not so limited and can be applied to other types of fluid discharge heads configured so that the drive voltage is supplied to a pressure generating element through a flexible printed circuit. For example, the invention may be applied to color material discharge heads used to manufacture color filters for liquid crystal display devices, electrode material discharge heads used to form electrodes for organic electro-luminescent displays and FED devices (field emission display), and organic material discharge heads used to manufacture biochips (biochemical devices).

The entire disclosure of Japanese Patent Application No. 2010-034388, filed Feb. 19, 2010, is expressly incorporated by reference herein.

What is claimed is:

1. A wiring member for a liquid ejection head that supplies a drive voltage to an actuator unit of the liquid ejection head, the liquid ejection head including an actuator unit that has a plurality of pressure generating elements that eject fluid from a nozzle communicating with a pressure chamber by changing the pressure of the fluid inside the pressure chamber by applying a drive voltage between an individual element electrode and a common element electrode, the wiring member comprising a flexible printed circuit that is separate from the actuator unit, the flexible printed circuit having formed thereon:

a plurality of individual electrode wiring terminals corresponding to individual element electrode terminals of the pressure generating elements;

individual electrode wires corresponding to the individual electrode wiring terminals;

a common electrode wiring terminal corresponding to a common element electrode terminal of the pressure generating elements; and a common electrode wire corresponding to the common electrode wiring terminal;

wherein the individual electrode wiring terminals, the common electrode wiring terminal, and the individual electrode wires are formed on one side of the flexible printed circuit, and the common electrode wiring is formed on the other side of the flexible printed circuit.

2. The liquid ejection head wiring member according to claim 1, further comprising:

a through-hole that connects the common electrode wiring terminal on one side to the common electrode wiring on the other side.

3. The liquid ejection head wiring member according to claim 1, wherein:

one end of the wiring member is bent so that the individual electrode wiring terminals and the common electrode wiring formed at the one end face element terminals of an actuator unit, and the wiring terminals are respectively connected to the corresponding element terminals.

4. A liquid ejection head that applies a drive voltage to a pressure generating element via the liquid ejection head wiring member according to claim 1, the liquid ejection head comprising:

an actuator unit which includes a plurality of the pressure generating elements that eject a fluid from a nozzle communicating with a pressure chamber by causing a variation in the pressure of the fluid inside the pressure chamber by applying a drive voltage between an individual element electrode and a common element electrode;

an individual element electrode connection portion which is electrically connected to the individual element electrode; and a common element electrode connection portion which is electrically connected to the common element electrode;

wherein the individual element electrode connection portion is connected to a corresponding individual electrode wiring terminal of the wiring member, and the common element electrode connection portion is connected to a corresponding common electrode wiring terminal of the wiring member.

5. A liquid ejection apparatus comprising:

the liquid ejection head according to claim 4.

6. The liquid ejection head wiring member according to claim 1, wherein the common electrode wiring terminal comprises a plurality of common electrode wiring terminals and the common electrode wire corresponds to the plurality of common electrode wiring terminals, wherein the plurality of individual electrode wiring terminals are in the middle of one of the plurality of common electrode wiring terminals located on a first side and another one of the plurality of common electrode wiring terminals located on a second side.

* * * * *